US008377619B2

(12) United States Patent
Hayashi et al.

(10) Patent No.: US 8,377,619 B2
(45) **Date of Patent: *Feb. 19, 2013**

(54) TONER AND TONER MANUFACTURING METHOD

(75) Inventors: Kenji Hayashi, Tokyo (JP); Mikio Kouyama, Tokyo (JP); Hiroaki Obata, Tokyo (JP); Noriyuki Kinpara, Tokyo (JP); Yasuhiko Muramatsu, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 269 days.

This patent is subject to a terminal disclaimer.

(21) Appl. No.: 12/824,930

(22) Filed: Jun. 28, 2010

(65) Prior Publication Data

US 2011/0003242 A1 Jan. 6, 2011

(30) Foreign Application Priority Data

Jul. 3, 2009 (JP) ..... 2009-158378

(51) Int. Cl.
*G03G 9/08* (2006.01)

(52) U.S. Cl. ..... 430/109.4; 430/137.15

(58) Field of Classification Search ..... 430/109.4, 430/137.15

See application file for complete search history.

(56) References Cited

U.S. PATENT DOCUMENTS

| | | | | |
|---|---|---|---|---|
| 5,035,970 | A * | 7/1991 | Hsieh et al. | 430/110.2 |
| 6,258,911 | B1 * | 7/2001 | Georges et al. | 526/346 |

FOREIGN PATENT DOCUMENTS

| | | |
|---|---|---|
| JP | 2000047430 | 2/2000 |
| JP | 2005173578 | 6/2005 |
| JP | 2009058927 | 3/2009 |
| JP | 2009109717 | 5/2009 |

* cited by examiner

*Primary Examiner* — Mark A Chapman
(74) *Attorney, Agent, or Firm* — Lucas & Mercanti, LLP

(57) ABSTRACT

Disclosed is a toner comprising at least a resin and a coloring agent, wherein the resin comprises toner particles in which a polyester resin unit is cross-linked by a diatomic cross-linking group expressed by a following general formula (1):

$$—X_1-(Y_1)X_1—$$

[wherein in the formula, $X_1$ denotes a linking group; and $Y_1$ denotes a radical polymer unit having a number average molecular weight Mn ranging from 5000 or more to 50000 or less, and a ratio Mw/Mn ranging from 1.0 or more to 1.2 or less, wherein Mw denotes a weight average molecular weight, and Mn denotes the number average molecular weight].

10 Claims, 4 Drawing Sheets

FIG.2

[ TABLE 1 ]

| EXAMPLE FORMULAE | n | n1 | n2 | OTHER SUBSTITUTION GROUPS | |
|---|---|---|---|---|---|
| (1)-1 | 38 | - | - | - | - |
| (1)-2 | - | 17 | 8 | | |
| (1)-3 | 479 | - | - | - | - |
| (1)-4 | - | 156 | 104 | - | - |
| (1)-5 | 228 | - | - | - | - |
| (1)-6 | 953 | - | - | - | - |
| (1)-7 | 1602 | - | - | x = 2 | - |
| (1)-8 | 154 | - | - | - | - |
| (1)-9 | 76 | - | - | R DENOTES H | R' DENOTES $CH_3$ |
| (1)-10 | 81 | - | - | - | - |
| (1)-11 | 139 | - | - | - | - |

FIG.3

[ TABLE 2 ]

| TELECHELIC POLYMER | STRUCTURAL FORMULA OF TELECHELIC POLYMER | | NUMBER AVERAGE MOLECULAR WEIGHT | Mw/Mn | COPOLYMERIZATION MOL RATIO |
|---|---|---|---|---|---|
| No. | X | Y | Mn | | |
| 1 | ACRYLOYL GROUP | n-BUTYL ACRYLATE | 5000 | 1.17 | - |
| 2 | ACRYLOYL GROUP | n-BUTYL ACRYLATE | 3000 | 1.19 | - |
| 3 | META-ACRYLOYL GROUP | n-BUTYL ACRYLATE | 50000 | 1.13 | - |
| 4 | ACRYLOYL GROUP | STYRENE | 26000 | 1.01 | - |
| 5 | ACRYLOYL GROUP | STYRENE/n-BUTYL ACRYLATE | 23000 | 1.15 | 7/3 |
| 6 | ACRYLOYL GROUP | STYRENE/n-BUTYL ACRYLATE | 26000 | 1.17 | 6/4 |
| 7 | META-ACRYLOYL GROUP | PROPYLENE | 45000 | 1.04 | - |

FIG. 4

[ TABLE 3 ]

| | TONER NO. | TELECHELIC POLYMER NO. OF GENERAL FORMULA (3) | OFFSET ON HIGH TEMPERATURE SIDE | OFFSET ON LOW TEMPERATURE SIDE | LOWER LIMIT TEMPERATURE OF FIXING | HEAT RESISTANT AND PRESERVABILITY OF TONER | | TEMPERATURE DEPENDENCY OF CHARGING |
|---|---|---|---|---|---|---|---|---|
| | | | | | | AGGREGATION RATE OF TONER (%) | EVALUATION | QL-QH( μ C/g) |
| EXAMPLE 1 OF PRESENT INVENTION | E-1 | 1 | 210℃ OR HIGHER | 120℃ | 125℃ | 10 | ◎ | 11.2 |
| EXAMPLE 2 OF PRESENT INVENTION | E-2 | 2 | 205℃ | 105℃ | 110℃ | 18 | ○ | 13.5 |
| EXAMPLE 3 OF PRESENT INVENTION | E-3 | 3 | 210℃ OR HIGHER | 125℃ | 130℃ | 13 | ◎ | 14.4 |
| EXAMPLE 4 OF PRESENT INVENTION | E-4 | 4 | 210℃ OR HIGHER | 115℃ | 120℃ | 9 | ◎ | 9.6 |
| EXAMPLE 5 OF PRESENT INVENTION | E-5 | 5 | 210℃ OR HIGHER | 105℃ | 110℃ | 10 | ◎ | 6.2 |
| EXAMPLE 6 OF PRESENT INVENTION | E-6 | 6 | 210℃ OR HIGHER | 110℃ | 115℃ | 11 | ◎ | 7.1 |
| EXAMPLE 7 OF PRESENT INVENTION | E-7 | 7 | 210℃ OR HIGHER | 135℃ | 140℃ | 9 | ◎ | 5.8 |
| COMPARATIVE EXAMPLE 1 | E-8 | 1 | 180℃ | 105℃ | 120℃ | 38 | × | 25.3 |
| COMPARATIVE EXAMPLE 2 | E-9 | - | 185℃ | 115℃ | 125℃ | 39 | × | 22.6 |

TONER AND TONER MANUFACTURING METHOD

CROSS-REFERENCE TO RELATED APPLICATION

The present U.S. patent application claims a priority under the Paris Convention of Japanese patent application No. 2009-158378 filed on Jul. 3, 2009, which shall be a basis of correction of an incorrect translation.

BACKGROUND OF THE INVENTION

1. Field of the Invention

The present invention relates to toner and a toner manufacturing method.

2. Description of Related Art

Techniques for decreasing power consumption of an electrophotographic printing system image forming apparatus, represented by a copier, a printer, and the like, have been examined in recent years under consideration for environment. As an example of the techniques, the technique of using a toner having a controlled melting property by using a polyester resin as a base material is disclosed.

For example, Japanese Patent Application Laid-Open Publication No. 2000-47430 discloses a toner aiming at coping with both of low-temperature fixability and offset resistance by including a hybrid resin component having a vinyl series copolymer unit and a polyester unit as binder resins.

Furthermore, Japanese Patent Application Laid-Open Publication No. 2009-58927 discloses a technique for keeping the elastic modulus and the fixation ratio of a toner by cross-linking the polyester including a trivalent carboxylic acid with a functional group capable of reacting with a carboxyl group.

Furthermore, Japanese Patent Application Laid-Open Publication No. 2005-173578 discloses a technique for reacting a polyester resin and a compound having an active hydrogen group by a cross-linking reaction. To put it concretely, the technique is the one for reacting an isocyanate modified polyester with a diamine compound by urea cross-linking.

Although the toners manufactured by the techniques described above have excellent low-temperature fixability, the toners easily generate a high-temperature offset because their viscosity at a high temperature falls. Furthermore, because the toners have a high cross-linking point density, formed by a functional group having a high polarity and a high moisture adsorbing rate, the changes of the amounts of water of the toners owing to the humidity has been large. Consequently, the toners have the remaining problem in which the humidity dependency of charging becomes excessive and the deterioration of image quality caused by the humidity cannot fully be corrected by the changes of development conditions.

Furthermore, the cases of performing the saddle stitching bookbinding and the Z fold bookbinding of images having high pixel rates have increased owing to the recent progress of the post-processing equipment of image forming apparatus. Consequently, it has been required to perform the improvement for the problem in which toner exfoliates from folds of an image even when low-temperature fixing can be performed on a smooth sheet. Japanese Patent Application Laid-Open Publication No. 2009-109717 discloses an improving technique of the fold fixability, but it is not yet sufficient.

SUMMARY OF THE INVENTION

The present invention was made in view of the situation mentioned above, and aims at providing a toner that is excellent in low-temperature fixability and can prevent the occurrence of high-temperature offsets and furthermore can make the humidity dependency of charging be small, and a manufacturing method of the toner.

To achieve at least one of the abovementioned objects, a toner reflecting one aspect of the present invention comprises: at least a resin and a coloring agent, wherein the resin comprises toner particles in which a polyester resin unit is cross-linked by a diatomic cross-linking group expressed by a following general formula (1):

$$—X_1-(Y_1)X_1— \qquad \text{general formula (1)}$$

[wherein in the formula, $X_1$ denotes a linking group; and $Y_1$ denotes a radical polymer unit having a number average molecular weight Mn ranging from 5000 or more to 50000 or less, and a ratio Mw/Mn ranging from 1.0 or more to 1.2 or less, wherein Mw denotes a weight average molecular weight, and Mn denotes the number average molecular weight].

To achieve at least one of the abovementioned objects, a toner manufacturing method reflecting another aspect of the present invention comprises:

dispersing a polyester resin including a polyhydric carboxylic acid component having an unsaturated double bond, and a telechelic polymer having a vinyl group on both tail ends of the telechelic polymer, in a water media;

manufacturing resin particles by polymerizing the polyester resin and the telechelic polymer; and mixing the resin particles with coloring agent particles formed by previous dispersion treatment, before cohering and fusing the resin particles and the coloring agent particles.

BRIEF DESCRIPTION OF THE DRAWINGS

The present invention will become more fully understood from the detailed description given hereinbelow and the appended drawings, and thus are not intended as definition of the limits of the present invention, wherein;

FIG. 2 shows Table 1;

FIG. 3 shows Table 2; and

FIG. 4 shows Table 3.

DETAILED DESCRIPTION OF THE PREFERRED EMBODIMENTS

Figure 1:
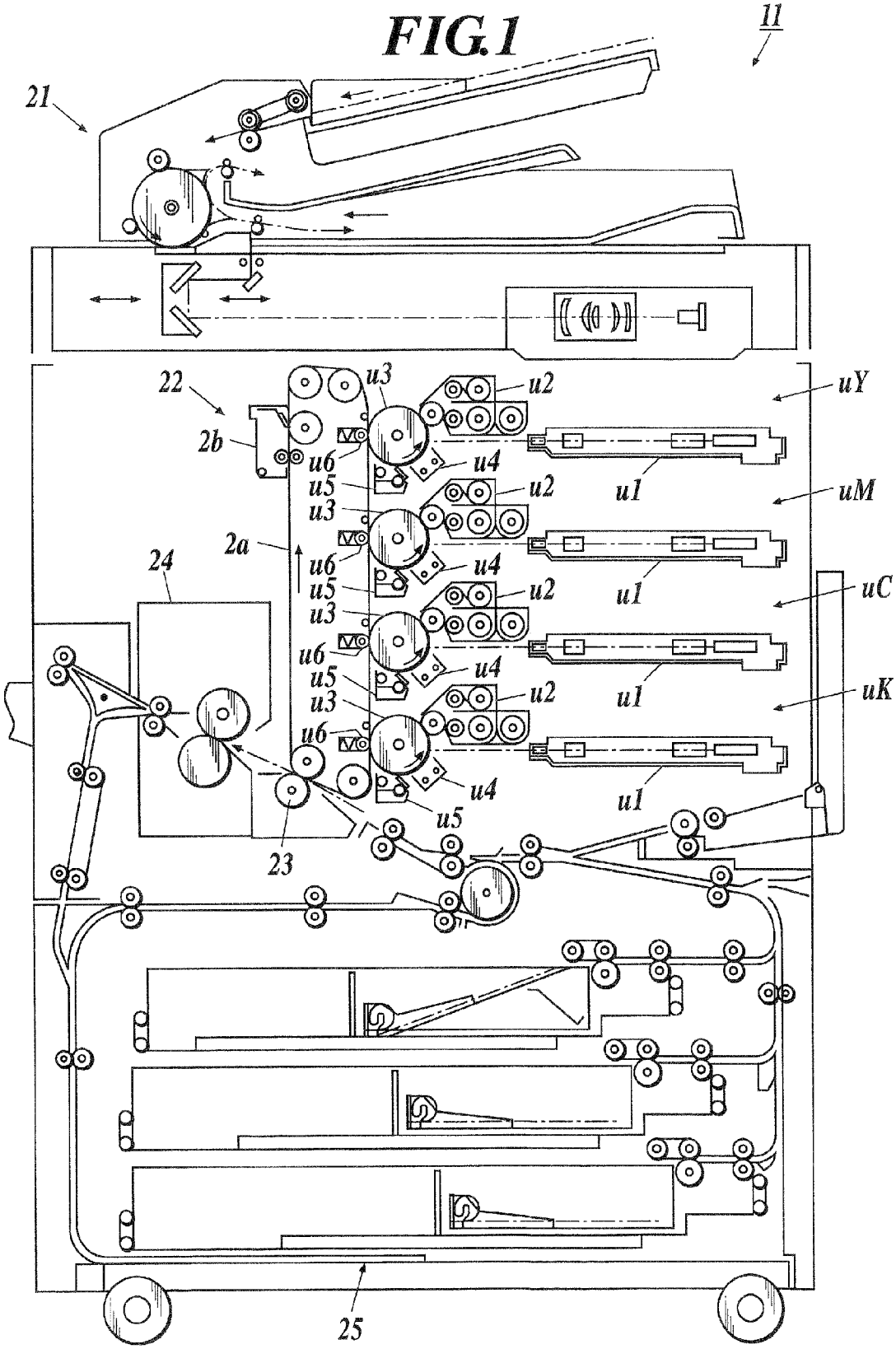
FIG. 1 is a diagram showing an example of an image forming apparatus.

In the following, the embodiments of the present invention will be described in detail with reference to the drawings.

<Toner>

The toner according to the present invention composed of toner particles including at least a resin and a coloring agent. In addition, various components, such as a release agent, an external additive, a charge control agent, inorganic powder (inorganic fine particles), and organic fine particles, can be added as the occasion demands. Furthermore, the toner according to the embodiment of the present invention preferably comprises a core-shell structure which is formed by a core and a shell.

In particular, the resin according to the embodiment of the present invention has the structure of being composed of a polyester resin unit and a telechelic polymer unit, formed by the polymerization of 25-1000, both inclusive, of radical polymerization monomer units.

In detail, the resin is a compound in which a polyester resin unit is cross-linked by a diatomic cross-linking group expressed by a following general formula (1):

$$—X_1-(Y_1)-X_1— \quad \text{general formula (1)}$$

[wherein in the formula, $X_1$ denotes a linking group; and $Y_1$ denotes a radical polymer unit having a number average molecular weight Mn ranging from 5000 or more to 50000 or less, and a ratio Mw/Mn ranging from 1.0 or more to 1.2 or less, wherein Mw denotes a weight average molecular weight, and Mn denotes the number average molecular weight].

To be more specific, the resin has the structure in which the telechelic polymer unit cross-links the polyester resin unit. To put it concretely, the resin is a compound expressed by following a general formula (2).

$$\begin{array}{l}[PE_S]\text{-}CH_2CR—CO—O-(Y_1)-O—CO—CR—CH_2\text{-}\\ \quad [PE_S]\end{array} \quad \text{General formula (2)}$$

[wherein in the formula, PEs denotes polyester; R denotes one of a methyl group and a hydrogen atom; and $Y_1$ denotes the radical polymer unit having the number average molecular weight Mn ranging from 5000 or more to 50000 or less, and the ratio Mw/Mn ranging from 1.0 or more to 1.2 or less, wherein Mw denotes the weight average molecular weight, and Mn denotes the number average molecular weight].

Here, $Y_1$ has the number average molecular weight Mn ranging from 20000 or more to 30000 or less, and more preferably, Mn ranging from 23000 or more to 26000 or less. Furthermore, $Y_1$ is preferably the radical polymer unit having Mw/Mn ranging from 1.1 or more to 1.2 or less, wherein Mw denotes the weight average molecular weight, and Mn denotes the number average molecular weight.

Still further, the weight average molecular weight Mw of the polyester resin unit preferably ranges from 4500 or more to 35000 or less.

<Polyester Resin>

The polyester can be obtained by the condensation polymerization of a polyhydric alcohol component as a raw material monomer and a polyhydric carboxylic acid as an acid component.

As the polyhydric carboxylic acid, for example, aromatic carboxylic acids, such as terephthalic acid, isophthalic acid, phthalic anhydride, trimellitic anhydride, pyromellitic acid, and naphthalenedicarboxylic acid, aliphatic carboxylic acids, such as maleic anhydride, fumaric acid, succinic acid, alkenyl succinic anhydride, and adipic acid, and alicyclic carboxylic acids, such as cyclohexanedicarboxylic acid can be given. One kind or two or more kinds of these polyhydric carboxylic acids can be used. It is preferable to use an aromatic carboxylic acid among these polyhydric carboxylic acids, and it is further preferable to use a trivalent or more carboxylic acid (such as trimellitic acid and an acid anhydride thereof) in conjunction with the dicarboxylic acid in order to form a cross-link structure or a branching structure in order to secure good fixability.

As the polyhydric alcohol, for example, one kind or two kinds or more of aliphatic diols, such as butanediol, hexanediol, and glycerin, and alicyclic diols, such as cyclohexanediol, cyclohexanedimethanol, and hydrogenated bisphenol A can be used. Aromatic diols and alicyclicdiols are preferable among these polyhydric alcohols, and the aromatic diols are more preferable between them. Furthermore, in order to form the cross-link structure or the branching structure in order to secure good fixability, a trivalent or more polyhydric alcohol (such as glycerin, trimethylolpropane, and pentaerythritol) may be used in conjunction with dial.

In addition, the acid number of the polyester resin may be adjusted by further adding monocarboxylic acid and/or monoalchol to the polyester resin obtained by the condensation polymerization of the polyhydric carboxylic acid and the polyhydric alcohol to esterify the hydroxyl group at the tail end of the polymerization and/or the carboxyl group. As the monocarboxylic acid, acetic acid, acetic anhydride, benzoic acid, trichloacetic acid, trifluoroacetic acid, propionic anhydride, and the like are given. As the monoalchol, methanol, ethanol, propanol, octanol, 2-ethylhexanol, trifluoroethanol, trichlorethanol, hexafluoroisopropanol, phenol, and the like can be given.

As a further preferable form of the present invention, the polyester resin, as a polyhydric carboxylic acid unit having unsaturated double bond, preferably takes the form of the copolymerization of fumaric acid or itaconic acid, at the rate of 1-30 mol %, both inclusive, (preferably, 1-15 mol %, both inclusive) of the whole acid component of the polyester resin. Thereupon, because it becomes possible that the fumaric acid or the itaconic acid is polymerized with the tail end of the telechelic polymer by the radical polymerization, the resin structure of the present invention can be realized. When the rate of the copolymerization is less than 1 mol %, the structure of the present invention cannot be obtained. When the rate is, on the other hand, larger than 30 mol %, the degree of cross-linkage becomes excessive, and it is apprehended that the low-temperature fixing becomes insufficient.

As a catalyst of the polyester resin, titanium catalyst can be given. To put it concretely, titanium tetraethoxide, titanium tetrapropoxide, titanium tetraisopropoxide, titanium tetrabutoxide, and the like can be given. As long as the titanium content is satisfied in the final toner, it is also possible to use the above titanium catalysts in conjunction with the other catalysts.

As other catalysts, for example, an alkali metal compound, such as sodium and lithium, an alkaline earth metal compound, such as magnesium and calcium, a metal compound, such as zinc, manganese, antimony, titanium, tin, zirconium, and germanium, phosphorous acid compound, phosphoric acid compound, amine compound, and the like can be given.

<Telechelic Polymer>

The telechelic polymer is the general term of polymer molecules that respectively include a functional group only on both the tail ends of the main chain of a linear polymer molecule.

In the present invention, the telechelic polymer having a vinyl group on both the tail ends is preferable for heightening the reactivity with the polyester resin, described below.

Furthermore, the polymer expressed by the following general formula (3), namely, "both the tail end (meta-)acryloyl telechelic polymer," is preferable, and the polymer will be described.

$$—X_2-(Y_1)-X_2— \quad \text{General formula (3)}$$

[wherein in the formula, $X_2$ denotes at least one of an acryloyl group and a meta-acryloyl group; and $Y_1$ denotes a radical polymer unit having a number average molecular weight Mn ranging from 5000 or more to 50000 or less, and a ratio Mw/Mn ranging from 1.0 or more to 1.2 or less, wherein Mw denotes a weight average molecular weight, and Mn denotes the number average molecular weight].

Here, $Y_1$ has the number average molecular weight Mn ranging from 20000 or more to 30000 or less, and more preferably, Mn ranging from 23000 or more to 26000 or less. Furthermore, $Y_1$ is preferably the radical polymer unit having Mw/Mn ranging from 1.1 or more to 1.2 or less, wherein Mw denotes a weight average molecular weight, and Mn denotes the number average molecular weight.

The compound expressed by the general formula (3) is called "both the tail end (meta-)acryloyl telechelic polymers," and is composed of a (meta-)acryloyl group on both the tail ends of its structure and a polymer formed by the radical polymerization at the center of the structure. In the present invention, the polymer formed by the radical polymerization at the center of the structure is called a radical polymerization monomer unit. In addition, in the present invention, "at least one of the acryloyl group and meta-acryloyl group" expressed by $X_2$ among the compounds expressed by the general formula (3) is also referred to as "(meta-)acryloyl group" or "(meta-)acryloyl."

The "both the tail end (meta-)acryloyl telechelic polymers" expressed by the general formula (3) are formed by a publicly known method, the one formed by a polymerization method called living radical polymerization, described below, is preferable. In the living radical polymerization, first, a vinyl series monomer is polymerized to form a main chain constituting a compound. Then, each of the tail ends is formed by adding two or more compounds including a carbon-carbon double bond at the end point of the polymerization, and the living radical polymerization includes a form of a polymer subjected to chain extension or a starlike polymer. Namely, the polymer formed by using the living radical polymerization easily forms a monodisperse molecular chain having an Mw/Mn in a range of 1.0 to 1.2, and a binder resin constituting the toner according to the present invention is easily manufactured by using the polymer. Consequently the polymer is preferable.

The vinyl series monomer constituting the polymer (the polymer referred to as the radical polymerization monomer unit in the present invention) at the part other than both the tail ends of the compound includes, for example, the following ones. The vinyl series monomer is at least one kind of composition selected from a (meta-)acrylic acid series monomer, a styrene series monomer, a fluorin including vinyl monomer, a silicon including vinyl series monomer, maleic anhydride, maleic acid, a monoalkyl ester and a dialkyl ester of maleic acid, fumaric acid, a monoalkyl ester and a dialkyl ester of fumaric acid, a maleimide series monomer, a nitrile group including vinyl series monomer, an amide group including vinyl series monomer, vinyl esters, alkenes, conjugated dienes, allyl alcohol, and the like. To be more specific, styrene, and n-butyl acrylate are preferable as vinyl series monomer.

Furthermore, the component corresponding to $Y_1$ in the above described telechelic polymer is preferably styrene/n-butyl acrylate copolymer, and the copolymerization ratio thereof preferably ranges in 6/4 to 7/3 by mol ratio.

In the following, concrete examples of the "both the tail end (meta-)acryloyl telechelic polymers" compounds expressed by the general formula (3) are shown, but the compounds capable of being used for the toners according to the present invention are not limited to the ones exemplified in the following.

(1)-1

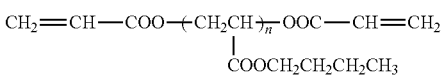

-continued (1)-2

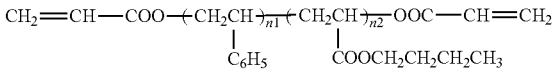

(1)-3

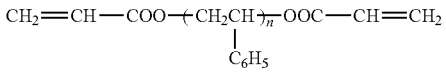

(1)-4

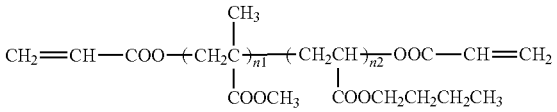

(1)-5

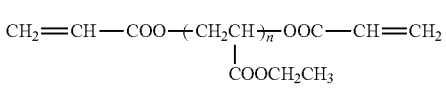

(1)-6

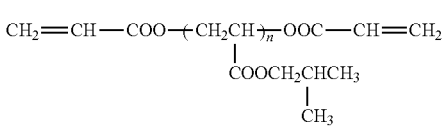

(1)-7

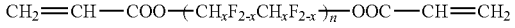

:XS IN THE FORMULA RESPECTIVELY DENOTE ANY ONE OF 0, 1, AND 2.

(1)-8

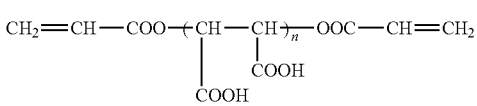

(1)-9

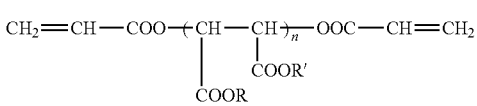

:R AND R′ IN THE FORMULA RESPECTIVELY DENOTE A HYDROGEN ATOM OR AN ALKYL GROUP.

(1)-10

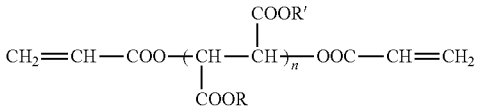

:R AND R′ IN THE FORMULA RESPECTIVELY DENOTE A HYDROGEN ATOM OR AN ALKYL GROUP.

(1)-11

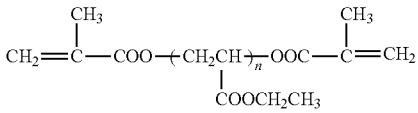

Here, "n", "n1", "n2", and other substitution groups included in the exemplified compounds shown in the above formulae respectively correspond to the numerical values of [Table 1] shown in FIG. 2.

Next, the living radical polymerization, which is one of the preferable forming methods of the compounds expressed by the general formula (3), will be described.

The living radical polymerization is the radical polymerization by which the activity of the tail ends of polymerization is not lost but is kept. The living radical polymerization means the polymerization performed with the tail ends continuously being subjected to activity in its narrowly-defined meaning, but includes the polymerization generally called pseudo-living radical polymerization, in which the polymerization is continued with an inactivated tail end and an activated tail end in an equilibrium state. The definition of the living radical polymerization in the present invention is the latter one.

The living radical polymerization includes, for example, the following polymerization.

(1) Polymerization Using a Radical Scavenger Such as a Cobalt Porphyrin Complex and a Nitroxide Compound (see, for example, J. Am. Chem. Soc. 1994, 116, 7943, Macromolecules, 1994, 27, 7228)

(2) Atom Transfer Radical Polymerization Using an Organic Halogenide and the Like as an Initiator and a Transition Metal Complex as a Catalyst, and the Like The atom transfer radical polymerization performs polymerization by using an organic halogenide, a sulphonyl halide compound, or the like as an initiator, and a metal complex having the central metal of a transition metal as a catalyst. The detailed descriptions pertaining to the atom transfer radical polymerization can be referred to, for example, the following documents.

(1) Documents by Matyjaszewski et al.

J. Am. Chem. Soc. 1995, 117, 5614

Macromolecules 1995, 28, 7901

Science 1996, 272, 866

(2) Documents by Sawamoto et al.

Macromolecules 1995, 28, 1721,

WO 96/30421 and WO 97/18247, Japanese Patent Application Laid-Open No. 2005-240048, and the like According to these documents, the living radical polymerization is the radical polymerization, in which polymerization progresses in a chain reaction and a polymer having a narrow molecular-weight distribution can be obtained. Furthermore, the molecular weight can freely be controlled by the reaction ratio of a monomer and an initiator.

<Coloring Agent>

As a coloring agent, as long as the coloring agent is a publicly known one, it is not particularly limited. For example, the following various ones can be given: inorganic pigments, such as carbon black including furnace black, channel black, acetylene black, thermal black, and the like, colcothar, smalt, and titanium oxide; azo pigments, such as fast yellow, diazo yellow, pyrazolone red, chelate red, brilliant carmine, and para brown; phthalocyanine pigments, such as copper phthalocyanine and metal-free phthalocyanine; and polycyclic dyes, such as flavanthrone yellow, dibromoanthrone orange, perylene red, quinacridone red, and dioxazin violet. Furthermore, the following various pigments can be given: chrome yellow, hansa yellow, bensidine yellow, slen yellow, quinoline yellow, permanent orange GTR, pyralozone orange, vulcan orange, watchyoung red, permanent red, Dupont oil red, lithol red, rhodamine B lake, lake red C, rose bengal, aniline blue, ultramarine blue, calco oil blue, methylene blue chloride, phthalocyanine blue, phthalocyanine green, malachite green oxalate, C. I. pigment red 48:1, C. I. pigment red 122, C. I. pigment red 57:1, C. I. pigment yellow 12, C. I. pigment yellow 97, C. I. pigment yellow 17, C. I. pigment blue 15:1, C. I. pigment blue 15:3, and the like. One kind or two and more kinds of these pigments can be used together.

<Release Agent>

As a release agent, as long as a release agent is publicly known, the release agent is not particularly limited. For example, natural waxes, such as carnauba wax, rice wax, and candelilla wax; ester waxes, such as synthesized fatty acid esters including low-molecular weight polypropylene, low-molecular weight polyethylene, sasol wax, microcrystalline wax, Fischer-Tropsch wax, paraffin wax, and montan wax, and montanic acid ester, and the like can be given. From the point of view of securing fixability, cleanability, and filming resistance, synthesized ester waxes are preferably used. Furthermore, one kind of these release agents may separately be used, or two or more kinds of them may be use in conjunction with each other. In order to obtain an image having a high texture without including any uneven brightness, it is preferable to use the microcrystalline wax, the Fischer-Tropsch wax, or the paraffin wax. From the point of view of preservability, the melting point of the release agent is preferably 50° C. or more, and is more preferably 60° C. or more. Furthermore, from the point of view of offset resistance, the melting point is preferably 90° C. or less, and is more preferably 86° C. or less.

<Charge Control Agent>

As a charge control agent constituting charge control agent particles, various publicly known agents capable of being dispersed in a water medium can be used. To put it concretely, a nigrosine series dye, a metal salt of naphthenic acid or a higher fatty acid, alkoxylate amine, a quaternary ammonium salt compound, an azo series metal complex, a salicylic acid metal salt or its metal complex, and the like can be given.

The charge control agent particles preferably have a number average of the diameters of primary particles of about 10-500 nm in a dispersed state.

<External Additive>

As inorganic fine particles as an external additive, for example, silica, alumina, titanium oxide, barium titanate, magnesium titanate, calcium titanate, strontium titanate, zinc oxide, silica sand, clay, mica, wollastonite, diatomite, cerium chloride, colcothar, chromium oxide, cerium oxide, antimony trioxide, magnesium oxide, zirconium oxide, silicon carbide, silicon nitride, and the like can be given. Among them, silicon fine particles and titanium oxide fine particles are preferable, and the fine particles subjected to hydrophobizing processing is especially preferable. The inorganic fine particles are generally used for the purpose of improving fluidity. The organic fine particles are generally used for the purpose of improving the cleanability and transferability, and more concretely, the organic fine particles of, for example, polystyrene, polymethyl methacrylate, and polyvinylidene fluoride are used for the object.

<Toner Manufacturing Method>

The toner of the present invention can be manufactured by the publicly known manufacturing methods, such as a grinding method, a suspension polymerization method, and an emulsion association method. It is preferable to use the following manufacturing method based on the emulsion association method from the point of view of heightening the efficiency of the reaction of a polyester resin and a telechelic polymer and further of uniforming the dispersion of the coloring agent and the release agent seat.

(1) Resin Dispersion Liquid Manufacturing Process of Dispersing the Polyester Resin and the Telechelic Polymer to Manufacture a Polyester Resin Dispersion Liquid, and Process of Polymerizing the Polyester Resin and the Telechelic Polymer to Manufacture Resin Particles When resin dispersion liquid manufacturing processes are roughly classified, the following methods can be given: (i) the method of forming a solution of a polyester resin and a telechelic polymer by using a solvent before forming emulsified droplets, and of manufacturing the resin particles of the present invention in the existence of a radical polymerization initiator and removing the solvent by the completion of the toner particles, (ii) the method of heating the polyester resin and the telechelic polymer without using any solvents to emulsify the polyester resin and the telechelic polymer in the state in which their melting viscosity has fallen, and of manufacturing the resin particles of the present invention in the existence of the radical polymerization initiator, and (iii) the method of emulsifying a polyester monomer and the telechelic polymer in the existence of a strong acid to condense the polyester monomer and the telechelic polymer in a water media, and of adding a radical polymerization initiator to manufacture the resin particles of the present invention.

The additives in the toner, such as the release agent, the charge control agent, and the coloring agent, can be used for the solution of the polyester resin and the telechelic polymer here by dissolving or dispersing the additives. To put it concretely, a stirring apparatus, such as a homomixer, ultrasonic waves, and a Manton-Gaulin homogenizer, can be given as the mixer. Furthermore, preferably used solvents are not limited as long as they can dissolve the polyester resin, but the followings can preferably be given: methyl acetate, ethyl acetate, methyl ethyl ketone, toluene, and xylene. The ethyl acetate is especially preferably used.

In any of the methods mentioned above, it is preferable that the particle diameters of the resin particles (polyester resin fine particles for a cores) of the present invention are 80-1000 nm in the case of being expressed as their volumetric basis median diameters from the point of view of the stability of cohesion, and are further preferably 100-400 nm.

The particle diameters of the polyester resin dispersion liquids measured in the examples and the comparative examples described in the following are volumetric basis median diameters. The median diameters were measured by the use of "MICROTRAC UPA 150" (made by Honewell International Inc.) under the following measurement conditions.

[Measurement Conditions]

Refraction Index of Sample: 1.59;

Specific Gravity of Sample (Converted into Globules): 1.05;

Refraction Index of Solvent: 1.33;

Viscosity of Solvent: $0.797\times10^{-3}$ Pa·s (30° C.), $1.002\times10^{-3}$ Pa·s (20° C.);

Adjustment of Zero Point: performed by adding an ion-exchanged water in measurement cell.

The polyester resin fine particles for cores preferably include 70 wt % or more of polyester resin. Furthermore, the polyester resin is preferably 80 wt % or more. As the components other than the noncrystalline polyester in the polyester resin fine particles for cores, a release agent, a coloring agent, a crystalline polyester, and a styrene acrylic resin may be included.

The molecular weight of the polyester resin is preferably 3000-70000 expressed by the weight average molecular weight, and is furthermore preferably 4000-35000.

In addition, the weight average molecular weights are those measured by the gel penetration chromatography (GPC). To put it concretely, the measurement sample is dissolved in tetrahydrofuran in order that the concentration of the toner is 1 mg/ml. As the dissolving condition, the dissolution is performed for 5 minutes by using an ultrasonic wave disperser at a room temperature. Next, 10 μL of the sample solution is poured into the GPC after treating the sample solution by a membrane filter having pores, each size of which is 0.2 μm. The concrete examples of the measurement condition of the GPC are shown in the following.

Apparatus: HLC-8220 (made by Tosoh Corporation)

Column: 40° C.

Solvent: tetrahydrofuran

Flow Speed: 0.2 ml/min

Detector: refraction index detector (RI detector)

The measurement of the molecular weights of the samples is performed by calculating the molecular-weight distribution of the samples by the use of the working curves measured by the use of monodisperse polystyrene standard particles. 10 pieces of polystyrene are used for the measurement.

Furthermore, the polyester resin fine particles for cores preferably includes 8.4-45.0% of a trivalent carboxylic acid in the whole acid monomer in order to control the acid number and the cohesiveness of the resin particles.

The weight average molecular weight of the polyester resin fine particles for cores is preferably 10000-30000 from the point of view of securing the fixability and the preservability.

(2) Coloring Agent Dispersion Liquid Manufacturing Process of Dispersing a Coloring Agent to Manufacture a Coloring Agent Dispersion Liquid The coloring agent dispersion liquid manufacturing process adjusts the dispersion liquid of coloring agent fine particles, in which the coloring agent is dispersed in fine particles, by adding a pigment, a coloring agent, to a water media and performing the dispersion treatment of the pigment with a disperser.

The water media used at the time of the polymerization of the coloring agent dispersion liquid and the resin dispersion liquid is a medium composed of 50-100 wt % of water, a surface active agent, and 0-5 wt % of water soluble organic solvent as the occasion demands. As the water soluble organic solvent, methanol, ethanol, isopropanol, butanol, acetone, methyl ethyl ketone, tetrahydrofuran, and the like can be given. It is preferable to use an alcoholic organic solvent, such as the methanol, the ethanol, the isopropanol, and the butanol, which is an organic solvent not to dissolve a produced resin.

Furthermore, although it is not especially limited, as the surface active agent used for the water media, it is possible to exemplify ionic surface active agents, including sulfonates (sodium dodecylbenzensulfonate, sodium aryl alkyl polyether sulfonate), and sulfate ester salts (sodium dodecyl sulfate, sodium tetradecyl sulfate, sodium pentadecyl sulfate, sodium octyl sulfate) as suitable ones. Furthermore, it is also possible to use nonionic surface agents including a polyethylene oxide, a polypropylene oxide, a combination of the polypropylene oxide and the polyethylene oxide, an ester of polyethylene glycol and a higher fatty acid, alkylphenol polyethylene oxide, an ester of a higher fatty acid and polyethylene glycol, an ester of a higher fatty acid and a polypropylene oxide, a sorbitan ester, and the like.

Because the coloring agent is uniformly dispersed in the dispersion treatment thereof, the dispersion treatment is preferably performed in the water media in the state in which the concentration of the surface active agent is a critical micelle concentration (CMC) or more.

The disperser used for the dispersion treatment is not especially limited, but it is preferable to use pressuring type dispersers, such as an ultrasonic wave disperser, a mechanical homogenizer, Manton-Gaulin homogenizer, and a pressure type homogenizer, and medium type dispersers, such as a sand grinder, a Getsman mill, and a diamond fine mill.

The particle diameters of the coloring agent fine particles in the coloring agent dispersion liquid are preferably 40-200 nm expressed by the volumetric basis median diameters.

(3) Process of Cohering and Fusing the Resin Particles and the Coloring Agent Particles with Each Other In this process, it is preferable to perform the salting-out with a divalent or trivalent salt (coagulant) to grow the particle diameters of cohered particles.

Furthermore, internally added agent fine particles, such as release agent fine particles and a charge control agent, can be cohered and fused together with the resin particles and the coloring agent fine particles of the present invention.

As the preferable coagulants used in the present invention, chloride salts, bromine salts, iodine salts, carbonates, sulfates, and the like, of magnesium, calcium, and barium can be given. Magnesium chloride and magnesium sulfate are preferable, and magnesium chloride is further preferable.

The coagulant is added at about the glass transition temperature of the resin particles for cores (polyester resin particles), and performs temperature rising as soon as possible after that to heat the coagulant to be the glass transition temperature of the resin particles of the present invention and within a range of 54-96° C.

(4) Process of Adding a Resin Particle Dispersion Liquid for a Shell (Shell Material) to Stop the Cohesion It is preferable to add a shell material from the point of view of securing the heat resistance and the storability of the toner.

As the shell material, the resin composed of the telechelic polymer unit and the polyester resin unit of the present invention, a polyester resin, a styrene acrylic resin, and the like can be used. The polarity of the resin particle dispersion liquid for the shell is preferably larger than those of the fine particles of the resin for the core, and a styrene acrylic resin is preferable from the point of view of controlling the polarity with a dissociative monomer. To put it concretely, the polarity can be controlled by introducing 4-11 wt % of acrylic acid or methacrylic acid into the styrene acrylic resin.

Furthermore, the glass transition points of the fine particles of the resin of the shell material are preferably higher than those of the resin particles of the present invention used at the process (3) by 5-30° C. Hereby, the improvement of heat resistance preservability can be achieved in addition to the low-temperature fixability. To put it concretely, the glass transition points of the fine particles of the resin of the present invention are preferably 30-55° C., and the glass transition points of the fine particles of the polyester resin for the shell are preferably 45-65° C. Furthermore, the glass transition points of the resin particles of the present invention are preferably 30-45° C., and the glass transition points of the fine particles of the polyester resin for the shell are preferably 50-60° C.

(5) Stopping Process of Adding a Cohesion Stopping Agent to Stop the Growth of the Particle Diameter At the time of arriving at a desired median diameter in the cohesion process, the cohesion stopping agent is added. The median diameter is preferably set to 4.0-8.5 μm on the volumetric basis in order to cope with both of the image quality and the cleanability.

The cohesion stopping agent is a compound for greatly weakening the salting-out force by the coagulant added in the particle diameter growing process, in other words, the cohesive forces of the resin particles. The cohesion stopping agent used for the present invention is a compound in which the hydrogen atom in a carboxyl group or a hydroxyl group in each of the following polycarboxylic acid or poly-organic carboxylic acid compounds is replaced with a monovalent metallic atom, such as sodium.

It is especially preferable to use the polycarboxylic acid. Because the polycarboxylic acid preferentially bonds to a diatomic metal ion, it is possible to weaken the salting-out force by the addition of the polycarboxylic acid. The additive amount of the polycarboxylic acid is preferable to be an equal mole or more to the diatomic metal ion, but it is also possible to adjust the cohesive speeds of the polyester resin particles to be slightly slower by the addition of the polycarboxylic acid by the equal mole or less. The polycarboxylic acid is a compound including two or more carboxyl groups in one molecule, and the polycarboxylic acid of the carbon number thereof being 12 or less is particularly preferable. Among the polycarboxylic acids, iminocarboxylic acid is particularly preferable. As concrete examples of the polycarboxylic acid, for example, compounds, such as ethylenediamine tetra acetic acid, trimellitic acid, and pyromellitic acid, can be given.

(6) Shape Control Process of Adjusting the Degree of Circularity of Cohered Particles After the stopping process, stirring and mixing are continued at a temperature within the range from the glass transition point to 97° C., both inclusive, preferably within the range of 54-65° C. When the degree of circularity of the toner becomes a desired value, the system is cooled, and the reaction is fixed. It is guessed that the increase of the degree of circularity of the toner with the lapse of time, namely the progress of sphering, is caused by the force of reducing the surface areas of the toner particles owing to the resin characteristics of the toner particles caused by their viscosity and surface tension.

By the shape control process, the particle-size distribution is formed to be further narrower, and it is possible to control the surfaces of the core particles to be smooth and uniform.

In addition, the degree of circularity of the toner is preferably 0.93-0.97. The degree of circularity is defined by the following formula here.

Degree of Circularity=(the length of the periphery of a circle having the same projection area as that of the image of a particle)/(the length of the periphery of the projection image of the particle)

Furthermore, the average degree of circularity is a value obtained by the calculation of dividing a value of the result of summing the degree of circularity of each particle by the total particle number. The degree of circularity of the toner is a value obtained by measuring the toner with "FPIA-2100" (made by Sysmex Corporation). To put it concretely, after adapting the toner in a water solution including a surface active agent and dispersing the toner by subjecting the toner to an ultrasonic wave dispersion treatment for one minute, measurement is performed by the use of "FPIA-2100." The measurement condition is: setting "FPIA-2100" to the high magnification ratio imaging (HPF) mode to make the HPF detection number a proper density of 3000-10000 particles to measure the circularity.

(7) Drying Process of Separating the Cohered Particles After the Shape Control Process from the Water Media and of Drying the Separated Cohered Particles After cooling the toner particle dispersion liquid after the shape control process, the toner particles are subjected to solid-liquid separation. After that, the toner cake subjected to the solid-liquid separation (a congregation of toner particles in a cake by cohering from their wet state) is subjected to washing treatment of removing the attachments, such as the surface active agent and the coagulant. The filtration treatment method of the toner cake is not particularly limited here, but may be a centrifugal separation method, a filtration method under a reduced pressure, performed by using a Nutsche or the like, a filtration method performed by using a filter press or the like, and the like.

Next, the toner cake is subjected to drying treatment, and dried particles colored in yellow are obtained. As the dryer used in this process, a spray dryer, a vacuum freeze dryer, a vacuum dryer, and the like can be given. In particular, it is preferable to use a static shelf dryer, a moving shelf dryer, a fluidized-bed dryer, a rotary dryer, a stirring dryer, and the like.

<Image Forming Method>

Next, an image forming method and an image forming apparatus that use the toner according to the present invention will be described.

With reference to FIG. 1, the image forming method and the image forming apparatus in the case of using the toner according to the present invention as a binary developing agent are described here. FIG. 1 shows an example of an image forming apparatus 11, performing image formation using the toner according to the present invention. The image forming apparatus 11 is called a tandem type color image forming apparatus.

As shown in FIG. 1, the image forming apparatus 11 is provided with an image reading apparatus 21 at the upper part of the main body thereof.

Furthermore, the image forming apparatus 11 is provided with units uY, uM, uC, and uK, performing exposure and development of each color of yellow (Y), magenta (M), cyan (C), and black (K), respectively. Each of the units uY, uM, uC, and uK includes an exposure apparatus u1, a development apparatus u2, a photosensitive body u3, a charging section u4, a cleaning section u5, and a primary transfer roller u6. The primary transfer roller u6 is pressed to be contact with the photosensitive body u3.

Furthermore, the image forming apparatus 11 is provided with an intermediate transfer unit 22, secondary transfer rollers 23, a fixing apparatus 24, and a paper feeding unit 25. The intermediate transfer unit 22 includes an intermediate belt 2*a*, wound around a plurality of rolls to be rotatably supported by the rolls, and a cleaning section 2*b*. The secondary transfer rollers 23 are pressed to be contacted with the intermediate belt 2*a*.

When the charging of the photosensitive body u3 is performed by the charging section u4 at the time of image formation, the exposure apparatus u1 performs exposure, and an electrostatic latent image based on an image signal is formed on the photosensitive body u3. Next, development is performed by the development apparatus u2, and toner adheres on the photosensitive body u3 to form a toner image. Then, the toner image is transferred onto the intermediate belt 2*a* by the rotation of the photosensitive body u3 and the operation of the primary transfer roller u6. This process of the exposure, the development, and the transfer is sequentially repeated by the units uY, uM, uC, and uK of the respective colors to the rotation of the intermediate belt 2*a* to superpose the toner image of each color on the intermediate belt 2*a*. Thus, a full color print is formed.

On the other hand, a sheet is conveyed from the paper feeding unit 25. When the sheet has been conveyed up to the position of the secondary transfer rollers 23, then the color image is collectively transferred from the intermediate belt 2*a* onto the sheet by the operation of the secondary transfer rollers 23. After that, the sheet is conveyed to the fixing apparatus 24, and the color image is fixed on the sheet by being pressurized and heated. When the color image is fixed, the sheet is finally ejected onto a tray provided on the outside. When the image formation ends in this way, the toner remaining on the photosensitive bodies u3 and the intermediate belt 2*a* are removed by the cleaning sections u5 in the intermediate transfer unit 22.

EXAMPLES

In the following, the embodiment of the present invention will concretely be described by giving examples, but the present invention is not limited to these examples.

<Manufacturing of Toners According to Examples and Comparative Examples>

1. Manufacturing Compounds (Both the Tail End (Meta-) Acryloyl Telechelic Polymers)

The "the compounds (both the tail end (meta-)acryloyl telechelic polymers) 1-7" expressed by the general formula (3) in Table 2 shown in FIG. 3 were manufactured by the living radical polymerization according to the rule. The structures, and the number average molecular weights of the "telechelic polymers 1-7," expressed by the general formula (3) are shown in Table 2. In addition, the copolymerization mol ratio of styrene/n-butyl acrylate in telechelic polymers 5, 6 is also shown in Table 2.

2. Manufacturing of Polyester Resin (a) Manufacturing of Polyester Resin (C-1)

(Polyvalent Carboxylic Monomer)

Terephthalic Acid: 31.9 mass parts

Fumaric Acid: 2.3 mass parts

Adipic Acid: 7.2 mass parts

5-Sulfoisophthalic Acid: 0.3 mass parts (Polyhydric Alcohol Component)

2,2-Bis(4-Hydroxyphenyl)Propane Propylene Oxide 2 Mol Adduct: 76 mass parts 2,2-Bis(4-Hydroxyphenyl)Propane Ethylene Oxide 2 Mol Adduct: 24 mass parts 3 mass parts, in total, of the polyvalent carboxylic monomer and the polyhydric alcohol component were prepared in a flask of the interior content of 5 liters provided with a stirring apparatus, a nitrogen introducing pipe, a temperature sensor, and a distillation column, and the temperature of the polyvalent carboxylic monomer and the polyhydric alcohol component were raised up to 190° C., the raising taking an hour. After ascertaining that the inside of the reaction system has been stirred uniformly, catalyst $Ti(OBu)_4$ (0.003 wt % of the whole quantity of the polyvalent carboxylic monomer) was projected.

Furthermore, the temperature was raised from that temperature to 240° C. while distilling away produced water, the raising taking 6 hours. The dehydration condensation reaction was further continued at 240° C. for 6 hours to perform polymerization, and thereby a polyester resin (C-1) was obtained. By the measurement of the molecular weight of the resin of the obtained polyester resin (C-1) by the GPC, it was found that the weight average molecular weight was 20000 and the number average molecular weight was 2800 (HLC-8 120 GPC made by Tosoh Corporation; converted by styrene standard substance).

(b) Manufacturing Polyester Resin (D-1)

A polyester resin (D-1) was manufactured by a way similar to that of the manufacturing of the polyester resin (C-1) except for the ratios of the polyvalent carboxylic monomers set as follows.

(Polyvalent Carboxylic Monomer)

Terephthalic Acid: 31.0 mass parts

Adipic Acid: 7.2 mass parts

5-Sulfoisophthalic Acid: 0.3 mass parts

3. Adjustment of Resin Particle Dispersion Liquid of the Present Invention (a) Adjustment of a Resin Particle Dispersion Liquid (A-1) of the Present Invention 2.7 mass parts of the "telechelic polymer 1" was added to 100 mass parts of the obtained polyester resin (C-1), and the solution was transported to Cavitron CD1010 (made by Eurotec Ltd.) at the speed of 100 mass parts per minute, being in its molten state. Dilute ammonia water of 0.37 wt % concentration, obtained by diluting reagent aqueous ammonia with an ion-exchanged water, was put into a separately prepared aqueous medium tank, and the dilute ammonia water was transported to Cavitron CD1010 (made by Eurotec Ltd.) at the speed of 0.1 liters per minute while heating to 160° C. with a heat exchanger at the same time as the molten state polyester resin (C-1). The resin particle dispersion liquid (A-1) of the present invention, having a volumetric basis median diameter of 217 nm, and a solid quantity of 30 mass parts, was obtained by operating Cavitron CD1010 under the conditions of: the rotation speed of the rotor thereof was 60 Hz and the pressure thereof was 51 g/cm$^2$.

Next, the resin particle dispersion liquid (A-1) of the present invention was prepared in the flask of the interior content of 5 liters, which flask provided with the stirring apparatus, the nitrogen introducing pipe, and the temperature sensor, and raised the temperature of the resin particle dispersion liquid (A-1) to 70° C. Then, 0.2 mass parts of potassium persulfate was added to the liquid, and the reaction was performed for 2 hours.

(b) Adjustment of the Resin Particle Dispersion Liquids (A-2)-(A-7) of the Present Invention The resin particle dispersion liquids (A-2)-(A-7) of the present invention were obtained by the processes similar to that of the manufacturing of the resin particle dispersion liquid (A-1) of the present invention except for the replacement of the "telechelic polymer 1" with each of "telechelic polymers 2-7," respectively.

Resin Particle Dispersion Liquid (A-2): 1.7 mass parts of telechelic polymer 2

Resin Particle Dispersion Liquid (A-3): 26.3 mass parts of telechelic polymer 3

Resin Particle Dispersion Liquid (A-4): 13.4 mass parts of telechelic polymer 4

Resin Particle Dispersion Liquid (A-5): 12 mass parts of telechelic polymer 5

Resin Particle Dispersion Liquid (A-6): 13.1 mass parts of telechelic polymer 6

Resin Particle Dispersion Liquid (A-7): 21.6 mass parts of telechelic polymer 7

(c) Adjustment of Resin Dispersion Liquid (A-8) for Comparison (Example of Not Performing Any Cross-Linking Reactions)

A resin dispersion liquid (A-8) for comparison was obtained by the process similar to that of the manufacturing of the resin particle dispersion liquid (A-1) except for replacing the polyester resin (C-1) with the polyester resin (D-1).

(d) Adjustment of Resin Particle Dispersion Liquid (A-9) for Comparison

A resin dispersion liquid (A-9) for comparison was obtained by the process similar to that of the manufacturing of the resin particle dispersion liquid (A-1) of the present invention except for not adding the "telechelic polymer 1" thereto.

4. Adjustment of Release Agent Dispersion Liquid

Tribehenate Citrate Wax (Melting Point 83.2° C.): 60 parts

Ionic Surface Active Agent (Neogen R K Made By Daiichi Kogyo Seiyaku Co., Ltd.): 5 parts Ion-Exchanged Water: 240 parts The solution in which the above components were mixed was heated to 95° C., and the solution was sufficiently dispersed with ULTRA-TURRAX T50 made by IKA Group. After that, the solution was subjected to dispersion treatment with pressure discharging type Gaulin Homogenizer to obtain a release agent dispersion liquid, having a volume average diameter of 240 nm and a solid quantity of 20 wt %.

5. Manufacturing of Resin Particles for Shell 600 mass parts of water was prepared in a reaction container, to which a stirring apparatus, a temperature sensor, a cooling pipe, and a nitrogen introducing apparatus are attached, and the internal temperature was raised to 70° C. with the water stirred at the stirring speed of 230 rpm in a nitrogen stream. 119 mass parts of styrene, 33 mass parts of n-butyl acrylate, 8 mass part of methacrylic acid, and 4.5 mass parts of n-octylmercaptan were added to the water, and a water solution including 3 mass parts of polymeric initiator (potassium persulfate; KPS) dissolved into 40 mass parts of ion-exchanged water is added. The system, was heated and stirred at 70° C. for 10 hours, and thereby shell forming resin particles were adjusted.

The weight average molecular weight (Mw) of the shell forming resin particles was 13200. Furthermore, the number average diameter of the composite resin particles constituting the shell forming resin particles was 221 nm, and the glass transition point temperature (Tg) was 55.4° C.

6. Manufacturing of Coloring Agent Fine Particle Dispersion Liquid 11.5 mass parts of n-sodium dodecyl sulfate 11.5 was stirred in 160 mass parts of ion-exchanged water, and was dissolved. 25 mass parts of C. I. Pigment Blue 15:3 was gradually added, and was next dispersed with "CLEARMIX W-MOTIONCLM-0.8" (made by M Technique Co., Ltd.) to obtain a coloring agent part particle dispersion liquid including coloring agent fine particles 1, having a volumetric basis median diameter of 158 nm.

In addition, the volumetric basis median diameter was measured under the measurement conditions mentioned above with "MICROTRAC UPA 150" (made by Honeywell International Inc.).

7. Manufacturing Toners (E-1)-(E-7) of the Present Invention and Toners (E-8) and (E-9) for Comparison (a) Manufacturing the Toner (E-1) of the Present Invention 400 mass parts (converted to solid content) of the resin particle dispersion liquid (A-1) of the present invention as the resin of a core, 200 mass parts of a release agent dispersion liquid, 1500 mass parts of ion-exchanged water, and 165 mass parts of coloring agent particle dispersion liquid were projected into a separable flask, provided with a thermometer, a cooling pipe, a nitrogen introducing apparatus, and a stirring apparatus. Furthermore, the pouvoir hydrogen (pH) was adjusted to 10 by adding an aqueous sodium hydroxide (25 wt %) with the temperature in the system kept at 30° C.

Next, a water solution obtained by dissolving 54.3 mass parts of magnesium chloride.6 hydrate into 54.3 mass parts of an ion-exchanged water was added, following that the temperature in the system was raised to 60° C. to start the agglutination reaction of the resin particles and the coloring agent particles.

After starting the agglutination reaction, sampling was periodically performed. When the particle volumetric basis median diameter ($D_{50}$) became 5.8 μm by the measurement with particle size distribution measuring apparatus "Coulter Multisizer 3" (made by Beckman Coulter, Inc.), 200 mass parts of "resin particles for a shell" were added as a shell material.

Furthermore, a water solution in which 2 mass parts of magnesium chloride.6 hydrate was dissolved in the ion-exchanged water was added, a time spent for 10 minutes. The stirring was continued until the particle volumetric basis median diameter ($D_{50}$) became 6.0 μm.

Furthermore, the stirring was continued for one hour with a temperature kept to 60° C., and 20.1 mass parts of ethylenediamine tetra-acetic acid was added. The degree of circularity of the toner particles at this time point was 0.951.

The temperature was raised to 65° C. to continue the stirring for 4 hours. When the degree of circularity of the toner particles arrived at 0.976, the solution was cooled to 30° C. under the condition of 6° C./minute, and the reaction was completed.

Next, the solid-liquid separation of the produced toner particle dispersion liquid was performed with basket type centrifugal separator "MARK III" (model number: 60×40) (made by MATSUMOTO KIKAI MFG. Co., LTD.) to form a wet cake of toner. After that, the washing and solid-liquid separation of the toner were repeated until the value of the electric conductivity of filtrate became 15 μS/cm or less.

Next, the wet cake was moved to air current type dryer "Flash Jet Dryer" (made by Seishin Enterprise Co., Ltd.), and the drying treatment of the wet cake was performed until the water amount became 0.5 wt %. In addition, the drying treatment was performed by blowing the wet cake with an air current of 40° C. and 20% RH. The dried toner was subjected to standing to cool to 24° C., and 1.0 mass part of hydrophobic silica was mixed to 100 mass parts of the toner with a Henschel mixer. The mixing was performed for 20 minutes under the condition of the peripheral speed of the rotor blades being 24 m/s, after that, the toner was made to pass through a sieve of 400 meshes. The obtained toner is set as the toner (E-1).

(b) Manufacturing the Toners (E-2)-(E-7) of the Present Invention

The toners (E-2)-(E-7) were obtained by the processes similar to that of the manufacturing of the toner (E-1) except for replacing the resin particle dispersion liquid (A-1) of the present invention with the resin particle dispersion liquids (A-2)-(A-7) of the present invention, respectively.

(c) Manufacturing the Toner (E-8) for Comparison

The toner (E-8) was obtained by the process similar to that of the manufacturing of the toner (E-1) except for replacing the resin particle dispersion liquid (A-1) of the present invention with the resin particle dispersion liquid (A-8) for comparison.

(d) Manufacturing the toner (E-9) for Comparison

The toner (E-9) for comparison was obtained by the process similar to that of the manufacturing of the toner (E-1) except for replacing the resin particle dispersion liquid (A-1) of the present invention with the resin particle dispersion liquid (A-9) for comparison.

8. Manufacturing of Binary Developing Agent (a) Manufacturing Binary Developing Agent (F-1)

100 parts of ferrite particles (made by Powdertech Co., Ltd.; average particle diameter: 50 μm) and 2 parts of methacrylate resin particles (average particle diameter of primary particles was 85 nm) were put in a horizontal stirring blade type high-speed stirring apparatus, and were mixed for 15 minutes at an ordinary temperature under the condition of the peripheral speed of the stirring blades was 8 m/s at 35° C. After that, the temperature of the mixture was raised to 110° C. and then the mixture was stirred for 2 hours. After that, the mixture was cooled, and the sizing of performed by the use of a sieve of 105 μm. Thereby, ferrite carriers (resin-coated carriers) were manufactured. The ferrite carriers and the static charge image developing toner (E-1) are mixed, and a binary system static charge image developing agent (F-1) having a toner concentration of 7 wt % was adjusted.

(b) Manufacturing Binary Developing Agents (F-2)-(F-7), and Binary Developing Agents (F-8) and (F-9) for Comparison Binary developing agents (F-2)-(F-9) were obtained by the processes similar to that of the manufacturing of the binary developing agent (F-1) except for replacing the toner (E-1) with toners (E-2)-(E-9).

9. Evaluation Experiment

Image formation was performed by using commercially available electrophotographic full color high-speed image forming apparatus bizhub PRO C5501 (made by Konica Minolta Business Technologies, Inc.) as an evaluation of a photograph taken from life. The result of each evaluation experiment is shown as Table 3 in FIG. 4.

(a) Fixing Offset Performance

The generation of image contamination caused by fixing offsets was evaluated by changing the temperature by the 5° C. in the range of 105-210° C. while conveying an A4-image having a solid zonal image by a longitudinal feed every temperature. The sample was an A4-image having a solid zonal image of a width of 5 mm and a halftone image of a width of 20 mm, both being perpendicular to the conveyance direction, and the image was conveyed by the longitudinal feed to be fixed. Then, the fixing temperatures at which image contamination was generated on the low temperature side and the high temperature side were evaluated. The fixing temperatures at which no image contamination was generated in the range of from 200° C. or higher on the high temperature side and the fixing temperatures at which no image contamination was generated in the range of from 150° C. or lower on the low temperature side were judged to be acceptable.

(b) Fixing Performance

Similarly to the "Evaluation of Fixing Offset Performance," fixed images were evaluated by changing the temperature of the fixing heat roller by the 5° C. in the range of 105-210° C. The evaluation was performed by performing development under the condition of setting the toner adhesion quantity on a transfer paper to 11 mg/cm$^2$, and by performing fixing treatment of the transfer paper, on which the toner image was formed, under the environment of a temperature of 10° C. and humidity of 10% RH.

The transfer paper subjected to the fixing treatment was bent at an image part with a folding machine, and the bent part was blown with the air of 0.35 MPa. After that, the situation of the image at the bent part was evaluated on the basis of the following evaluation criteria. In the evaluation, the fixing temperature at the rank 3 among the 5 steps of ranks was evaluated as a lower limit fixing temperature. The transfer paper having the lower limit fixing temperature of 150° C. or lower was judged to be acceptable.

(Evaluation Criteria)

Rank 5: No exfoliation of a toner image was found at all at a crease.

Rank 4: Extremely slight exfoliation of a toner image was detected only at a part of a crease.

Rank 3: Thin linear exfoliation could be found along a crease, which caused no problems practically.

Rank 2: Thick exfoliation could be found along a crease, which caused a practical problem.

Rank 1: Large exfoliation was generated on an image.

(c) Heat Resistance and Preservability of Toners

The heat resistance and the preservability of a toner were evaluated in the following process. First, 0.5 g of the toner was extracted in a glass bottle of 10 ml, which glass bottle has an inner diameter of 21 mm, and the cap thereof was closed to be shaken by 600 times with a tap denser "KYT-2000 (made by Seishin Enterprise Co., Ltd.). After that, the cap was taken off, and the glass bottle was left as it was in an environment of a temperature of 57° C. and humidity of 35% RH for 2 hours. Next, the toner was placed on a sieve of 48 meshes (aperture 350 μm) so as not to be shredded, and was set in "Powder Tester" (made by Hosokawa Micron Corporation) to be fixed with a pressure bar and a knob nut.

The toner was vibrated for 10 seconds after adjusting "Powder Tester" to the vibration strength of a feed width of 1 mm. After that, the toner quantity remaining on the sieve was measured, and the ratio of the remaining toner was calculated to obtain a toner aggregation rate (wt %). Thus, the toner aggregation rate was used as the evaluations of the heat resistance and the preservability.

The toner aggregation rate was calculated by the following formula:

Toner Aggregation Rate (wt %)=[(toner mass remaining on the sieve (g))/0.5 (g)]×100.

The evaluations of the heat resistance and the preservability were performed on the basis of the following criteria:

◎: The toner aggregation rate was less than 15 wt % (the heat resistance and the preservability were extremely good).

○: The toner aggregation rate was 15-20 wt %, both inclusive (heat resistance and preservability were good).

x: The toner aggregation rate exceeded 20 wt % (the heat resistance and preservability of the toner were bad and could not be used)

Among above criteria, ◎ and ○ were judged to be acceptable.

(d) Humidity Dependency of Charging

Humidity Dependency of Charging

A sample was left as it was in each of a low temperature low humidity environment (temperature: 10° C., humidity: 15% RH) and a high temperature high humidity environment (temperature: 30° C., humidity: 85% RH) for 24 hours or longer. After that, the respective charge quantities QL and QH were measured by the publicly known blowoff method to calculate QL-QH as a range of fluctuation in the charge quantity pertaining to humidity dependency. The case where the range of fluctuation in the charge quantity pertaining to the humidity dependency was less than 10 μC/g was evaluated as "superior"; the case where the range was from 10 μC/g, inclusive, to 20 μC/g was evaluated as "good"; and the case where the range was 20 μC/g or more was evaluated as "bad."

As shown in Table 3, it can be recognized that the examples 1 to 7 including the "telechelic polymer 1" to "telechelic polymer 7", respectively, can prevent high-temperature offsets and are excellent in low-temperature fixability and their humidity dependency of charging is also small, which is preferable.

According to an aspect of the preferred embodiment of the present invention, provided is a toner comprising at least a resin and a coloring agent, wherein the resin comprises toner particles in which a polyester resin unit is cross-linked by a diatomic cross-linking group expressed by a following general formula (1):

$$—X_1-(Y_1)-X_1— \quad \text{general formula (1)}$$

[wherein in the formula, $X_1$ denotes a linking group; and $Y_1$ denotes a radical polymer unit having a number average molecular weight Mn ranging from 5000 or more to 50000 or less, and a ratio Mw/Mn ranging from 1.0 or more to 1.2 or less, wherein Mw denotes a weight average molecular weight, and Mn denotes the number average molecular weight].

Preferably, the resin is a compound expressed by a following general formula (2):

$$[PE_S]-CH_2CR—CO—O-(Y_1)-O—CO—CR—CH_2-[PE_S] \quad \text{general formula (2)}$$

[wherein in the formula, PEs denotes polyester; R denotes one of a methyl group and a hydrogen atom; and $Y_1$ denotes the radical polymer unit having the number average molecular weight Mn ranging from 5000 or more to 50000 or less, and the ratio Mw/Mn ranging from 1.0 or more to 1.2 or less, wherein Mw denotes the weight average molecular weight, and Mn denotes the number average molecular weight].

Preferably, the polyester resin unit comprises a polyhydric carboxylic acid unit including an unsaturated double bond.

Preferably, the linking group expressed by the general formula (1) of the resin is a linking group derived from a telechelic polymer.

Preferably, $Y_1$ is styrene/n-butyl acrylate copolymer.

Preferably, $Y_1$ is the radical polymer unit having Mw/Mn ranging from 1.1 or more to 1.2 or less.

Preferably, $Y_1$ has the number average molecular weight Mn ranging from 20000 or more to 30000 or less.

Preferably, $Y_1$ has the number average molecular weight Mn ranging from 23000 or more to 26000 or less.

Preferably, the weight average molecular weight Mw of the polyester resin unit ranges from 4500 or more to 35000 or less.

Preferably, the polyhydric carboxylic acid unit including the unsaturated double bond is fumaric acid unit.

Preferably, the toner comprises a core-shell structure.

According to another aspect of the preferred embodiment of the present invention, provided is a toner manufacturing method, comprising:

dispersing a polyester resin including a polyhydric carboxylic acid component having an unsaturated double bond, and a telechelic polymer having a vinyl group on both tail ends of the telechelic polymer, in a water media;

manufacturing resin particles by polymerizing the polyester resin and the telechelic polymer; and mixing the resin particles with coloring agent particles formed by previous dispersion treatment, before cohering and fusing the resin particles and the coloring agent particles.

Preferably, the telechelic polymer having the vinyl group on both tail ends, is expressed by a following general formula (3):

$$—X_2-(Y_1)-X_2— \quad \text{general formula (3)}$$

[wherein in the formula, $X_2$ denotes at least one of an acryloyl group and a meta-acryloyl group; and $Y_1$ denotes a radical polymer unit having a number average molecular weight Mn ranging from 5000 or more to 50000 or less, and a ratio Mw/Mn ranging from 1.0 or more to 1.2 or less, wherein Mw denotes a weight average molecular weight, and Mn denotes the number average molecular weight].

Preferably, the telechelic polymer is obtained by living radical polymerization.

According to the present invention, the falling of the viscosity of a toner at a high temperature is suppressed and the generation of high-temperature offsets decreases by forming a cross-link structure in a polyester resin. When a conventional cross-linking agent is used, the molecular-weight distribution of the toner becomes broad owing to cross-linking, and it has been impossible to obtain a sharp melt property. Accordingly, the present invention remarkably improves the fold fixability while keeping the low-temperature fixability by giving the polyester resin a gentle cross-link structure by using a telechelic polymer, which has a long chain length and a uniform molecular weight. Furthermore, the dispersion of the heat characteristic of the toner reduces by using a cross-linking agent component having a uniform length, and thereby a sharp melt property can be obtained. Namely, it becomes possible to cope with both of the realization of the low-temperature fixability and the prevention of the high-temperature offset more successfully in comparison with conventional techniques. Furthermore, it is supposed that, because the present invention can make the density at cross-linking points, at which the adsorption of water molecules is caused, sparse, also the humidity dependency of charging can be reduced.

Although various exemplary embodiments have been shown and described, the invention is not limited to the embodiments shown. Therefore, the scope of the invention is intended to be limited solely by the scope of the claims that follow.

What is claimed is:

1. A toner comprising at least a resin and a coloring agent, wherein the resin comprises a polymer in which a polyester resin unit is cross-linked by a diatomic cross-linking group expressed by a following general formula (1):

$$—X_1-(Y_1)-X_1— \quad \text{general formula (1):}$$

[wherein in the formula, $X_1$ denotes a linking group; and $Y_1$ denotes a radical polymer unit having a number average molecular weight Mn ranging from 5000 or more to 50000 or less, and a ratio Mw/Mn ranging from 1.0 or more to 1.2 or less, wherein Mw denotes a weight average molecular weight, and Mn denotes the number average molecular weight], wherein the polyester resin unit has an unsaturated double bond, wherein, the diatomic cross-linking group expressed by the general formula (1) is a telechelic polymer having on both tail ends thereof a vinyl group, and wherein the polyester resin unit and the telechelic polymer are polymerized at the unsaturated double bond of the polyester resin unit and the vinyl group of the telechelic polymer on both tail ends.

2. The toner as claimed in claim 1, wherein the resin is a compound expressed by a following general formula (2):

$$[PE_S]-CH_2CR—CO—O-(Y_1)-O—CO—CR—CH_2-[PE_S] \quad \text{general formula (2):}$$

[wherein in the formula, PEs denotes polyester; R denotes one of a methyl group and a hydrogen atom; and $Y_1$ denotes the radical polymer unit having the number average molecular weight Mn ranging from 5000 or more to 50000 or less, and the ratio Mw/Mn ranging from 1.0 or more to 1.2 or less, wherein Mw denotes the weight average molecular weight, and Mn denotes the number average molecular weight].

3. The toner as claimed in claim 1, wherein the polyester resin unit comprises a polyhydric carboxylic acid unit including an unsaturated double bond.

4. The toner as claimed in claim 3, wherein the polyhydric carboxylic acid unit including the unsaturated double bond is fumaric acid unit.

5. The toner as claimed in claim 1, wherein $Y_1$ is styrene/n-butyl acrylate copolymer.

6. The toner as claimed in claim 1, wherein $Y_1$ is the radical polymer unit having Mw/Mn ranging from 1.1 or more to 1.2 or less.

7. The toner as claimed in claim 6, wherein, $Y_1$ has the number average molecular weight Mn ranging from 23000 or more to 26000 or less.

8. The toner as claimed in claim 1, wherein $Y_1$ has the number average molecular weight Mn ranging from 20000 or more to 30000 or less.

9. The toner as claimed in claim 1, wherein the weight average molecular weight Mw of the polyester resin unit ranges from 4500 or more to 35000 or less.

10. The toner as claimed in claim 1, wherein the toner comprises a core-shell structure.

* * * * *